US006285360B1

(12) United States Patent
Li

(10) Patent No.: US 6,285,360 B1
(45) Date of Patent: Sep. 4, 2001

(54) REDUNDANT ROW DECODER

(75) Inventor: Poking Li, San Jose, CA (US)

(73) Assignee: Aurora Systems, Inc., San Jose, CA (US)

( * ) Notice: Subject to any disclaimer, the term of this patent is extended or adjusted under 35 U.S.C. 154(b) by 0 days.

(21) Appl. No.: 09/075,411

(22) Filed: May 8, 1998

(51) Int. Cl.[7] ..... G09G 5/00
(52) U.S. Cl. ..... 345/204
(58) Field of Search ..... 345/204, 84, 93; 365/200

(56) References Cited

U.S. PATENT DOCUMENTS 5,652,725 * 7/1997 Suma et al. ..... 365/200
5,670,976 * 9/1997 Chiu et al. ..... 345/84
5,805,248 * 9/1998 Sakamoto et al. ..... 345/93

* cited by examiner

*Primary Examiner*—Richard Hjerpe
*Assistant Examiner*—Ronald Laneau
(74) *Attorney, Agent, or Firm*—Henneman & Saunders; Larry E. Henneman, Jr.

(57) ABSTRACT

An improved video display driver circuit (300) having an improved pixel array (302). The pixel array has a plurality of row enable lines (138) which extend from both sides thereof such that the row enable lines (138) are connected at one end to a row decoder (104) and at the other end to a redundant row decoder (304). Upon the occurrence of a circuit discontinuity (450), there will still be a complete circuit from either the row decoder (104) or the redundant row decoder (304) to each of a plurality of pixel cells (200) such that a video image produced by the improved pixel array (302) will not be impaired by the circuit discontinuity (450).

12 Claims, 4 Drawing Sheets

REDUNDANT ROW DECODER

TECHNICAL FIELD

The present invention relates to the field of electronic circuitry, and more particularly to address decoders such as are used for decoding row or column information in a video pixel array device. The predominant current usage of the inventive redundant row decoder is in the decoding of row information in video pixel array devices, wherein it is desirable to prevent the pixel array from being rendered unusable merely because it might posses minor physical defects.

BACKGROUND ART

FIG. 1 shows a prior art display driver circuit 100, for driving a pixel array 102, which includes an array of pixel cells arranged in 768 rows and 1024 columns. Display driver circuit 100 includes row decoder 104, write hold register 106, pointer 108, instruction decoder 110, invert logic 112, timing generator 114, and input buffers 116, 118, and 120. Driver circuit 100 receives clock signals via SCLK terminal 122, invert signals via invert (INV) terminal 124, data and addresses via 32-bit system data bus 126, and operating instructions via 2-bit op-code bus 128, all from a system (e.g., a computer) not shown. Timing generator 114 generates timing signals, by methods well known to those skilled in the art, and provides these timing signals to the components of driver circuit 100, via clock signal lines (not shown), to coordinate the operation of each of the components.

Invert logic 112 receives the invert signals from the system via INV terminal 124 and buffer 116, and receives the data and addresses from the system via system data bus 126 and buffer 118. Responsive to a first invert signal ( ), invert logic 112 asserts the received data and addresses on a 32-bit internal data bus 130. Responsive to a second invert signal (INV), invert logic 112 asserts the complement of the received data on internal data bus 130. Internal data bus 130 provides the asserted data to write hold register 106, and provides the asserted row addresses (via 10 of its 32 lines) to row decoder 104.

Instruction decoder 110 receives op-code instructions from the system, via op-code bus 128 and buffer 120, and, responsive to the received instructions, provides control signals, via an internal control bus 132, to row decoder 104, write hold register 106, and pointer 108. Responsive to the system asserting data on system data bus 126 and a first instruction (i.e., Data Write) on op-code bus 128, instruction decoder 110 asserts control signals on control bus 132, causing write hold register 106 to load the asserted data via internal data bus 130 into a first portion of write hold register 106. Because internal data bus 130 is only 32 bits wide, 32 data write commands are necessary to load an entire line (1024 bits) of data into write hold register 106. Pointer 108 provides an address, via a set of lines 134, which indicates the portion of write hold register 106 to which the data is to be written. As each successive Data Write command is executed, pointer 108 increments the address asserted on lines 134 to indicate the next 32-bit portion of write hold register 106.

Responsive to the system asserting a row address on system data bus 126 and a second instruction (i.e., load row address) on op-code bus 128, instruction decoder 110 asserts control signals on control bus 132 causing row decoder 104 to store the asserted row address. Then, responsive to the system asserting a third instruction (i.e., Array Write) on op-code bus 128, instruction decoder 110 asserts control signals on control bus 132, causing write hold register 106 to assert the 1024 bits of stored data on a set of 1024 data output terminals 136, and causing row decoder 104 to decode the stored row address and assert a write signal on one of a set of 768 row enable lines 138 corresponding to the decoded row address. The write signal on the corresponding row enable line causes the data being asserted on data output terminals 136 to be latched into a corresponding row of pixel cells (not shown in FIG. 1) of pixel array 102.

FIG. 2 shows an exemplary pixel cell 200(*r*,*c*) of display 102, where (r) and (c) indicate the row and column of the pixel cell 200, respectively. Pixel cell 200 includes a latch 202, a pixel electrode 204, and switching transistors 206 and 208. Latch 202 is a static random access memory (SRAM) latch. One input of latch 202 is coupled, via transistor 206, to a Bit+ data line 210(*c*), and the other input of latch 202 is coupled, via transistor 208 to a Bit− data line 212(*c*). The gate terminals of transistors 206 and 208 are coupled to row enable line 138(*r*). An output terminal 214 of latch 202 is coupled to pixel electrode 204. A write signal on row enable line 138(*r*) places transistors 206 and 208 into a conducting state, causing the complementary data asserted on data lines 210(*c*) and 212(*c*) to be latched, such that the output terminal 214 of latch 202, and coupled pixel electrode 204, are at the same logic level as data line 210(*c*).

It should be noted that that the above described display driver circuit 100 is presented by way of example only, and it is not represented that this example is the only way to provide signals to the pixel array 102. However, whatever the method or apparatus used for delivering a write signal to pixel cell 200 from row decoder 104 (FIG. 1) via the row enable line 138(*r*), there has existed in the prior art a problem that the row enable line 138(*r*) is fragile and quite susceptible to flaws during the manufacturing process or thereafter. When a row enable line 138(*r*) fails to make a complete electrical path across the pixel array 102 (FIG. 1) a portion of a row of pixel cells 200 (*r*,*c*) will not be operable. Although this will not particularly render the assembled pixel array 102 and display driver circuit 100 entirely inoperable, it will likely result in a perceptible flaw in the perceived visual display, and is unacceptable.

It would be desirable to have a video display driver which could withstand open circuits in the lines enabling rows of the pixel array without suffering a deterioration of the video image produced thereby. However, to the inventor's knowledge no such apparatus or method has existed in the prior art.

DISCLOSURE OF INVENTION

Accordingly, it is an object of the present invention to provide a video array which will produce a quality image even where a row driver circuit might be damaged or open.

It is still another object of the present invention to provide a video array driver which will result in a higher production yield.

It is yet another object of the present invention to provide a method and apparatus for potentially improving the image produced by a video array device and associated circuitry.

Briefly, the present invention is embodied in an improved video pixel array driver and associated circuitry having a redundant row driver positioned such that a break in row driver lines within the video array will not result in a loss of picture quality. That is, the entire row will still be operable even where there is an open circuit in the row driver line associated with that row. The improved video display circuitry with redundant row decoder will result in higher production yields because video display devices which might be produced with inherent flaws in the row driver circuitry within the pixel array will be quite usable whereas in the prior art such devices would have to be scrapped as being flawed. While in some applications it might be desirable to disable unnecessary driver rows at the production stage, in the example shown the redundant row decoder remains active such that even where row driver lines within the pixel array might become damaged after manufacture, displays produced according to the present invention will still be functional and will appear to be unflawed to the user.

An advantage of the present invention is that video display devices can be used even where minor flaws might have previously rendered the unit unacceptable for sale.

A further advantage of the present invention is that production yield of video display devices can be improved.

Yet another advantage of the present invention is that video display devices will be more rugged and less prone to failure or degradation of picture quality.

Still another advantage of the present invention is that it is inexpensive and easy to implement.

These and other objects and advantages of the present invention will become clear to those skilled in the art in view of the description of the invention and the industrial applicability of the invention as described herein and as illustrated in the several figures of the drawing.

DETAILED DESCRIPTION OF THE INVENTION

This application is related in subject matter to a copending application Ser. No. 08/970,443 entitled INTERNAL ROW SEQUENCER FOR REDUCING BANDWIDTH AND PEAK CURRENT REQUIREMENTS IN A DISPLAY DRIVER CIRCUIT which teaches an improved display driver circuit configuration as compared to the above prior art, and is incorporated by reference herein. Although the present invention will be described herein as being embodied in generally conventional circuit, the scope of the invention will be sufficient to use in conjunction with other display driver circuits such as the one described in the above referenced application. Additionally, the present invention is related in subject matter to copending application Ser. No. 08/970,665 entitled SYSTEMS AND METHOD FOR REDUCING PEAK CURRENT AND BANDWIDTH REQUIREMENTS IN A DISPLAY DRIVER CIRCUIT, in that one skilled in the art will recognize, in light of the following disclosure, that the present invention could also be adapted for use on the select lines in double buffered arrays, and the like.

Figure 1:
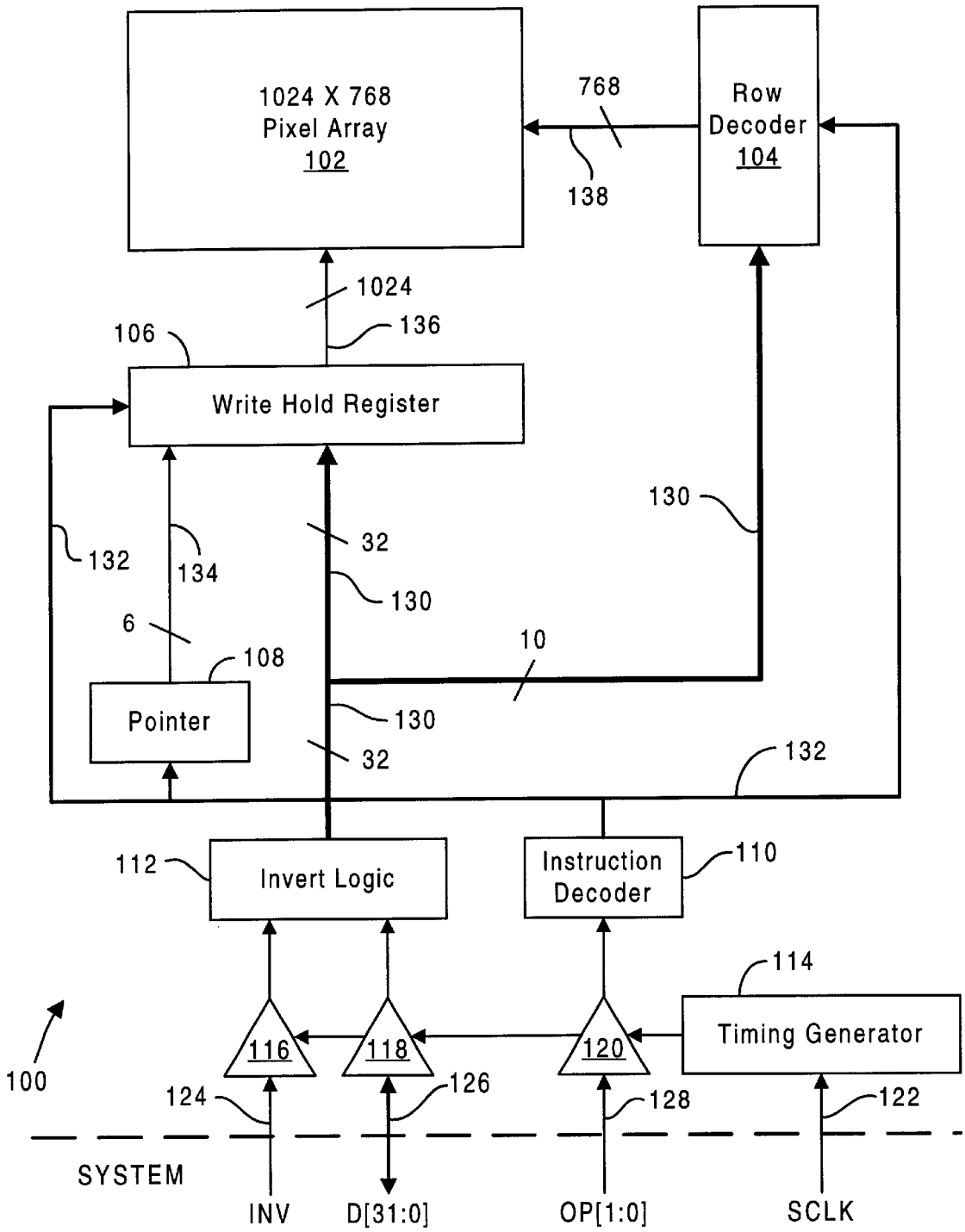
FIG. 1 Prior Art
FIG. 1 is a block diagram of a prior art display driver circuit.
Figure 3:
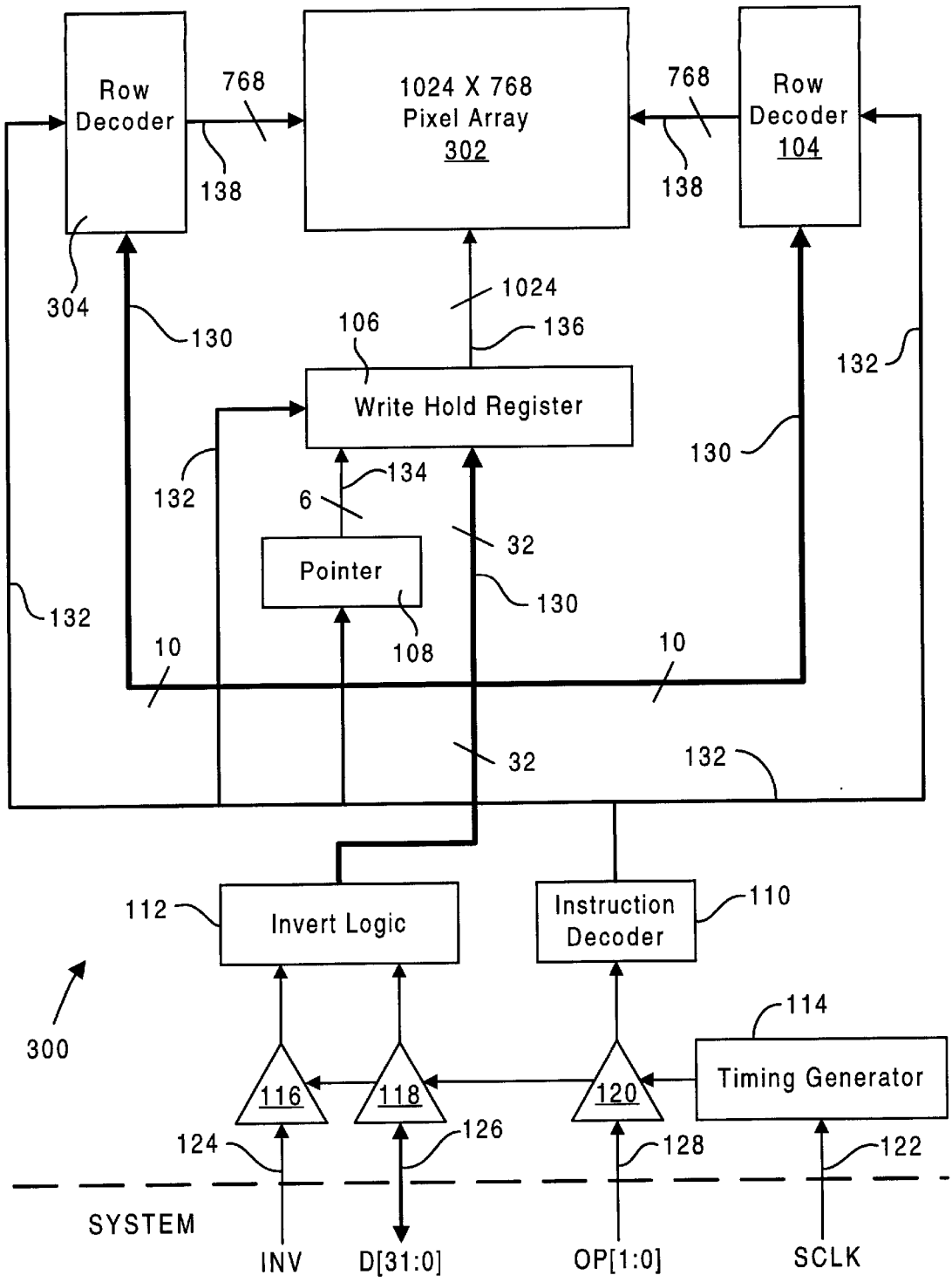
FIG. 3 is a block diagram, similar to the view of FIG. 1 showing a video display driver circuit including a redundant row decoder according to the present invention.

An improved video display driver circuit is depicted in the block schematic diagram of FIG. 3 and is designated therein by the general reference character 300. The improved video display driver circuit 300 is, in many respects similar to the prior art described herein in relation to FIG. 1 with the significant exception that a redundant row decoder 304 is provided and an improved pixel array 302 differs from the prior art pixel array 102 (FIG. 1) as will be discussed in further detail hereinafter. As discussed previously herein, the row decoder 104 receives an input signal and selectively outputs row enable signals on a plurality of row enable lines 138. Similarly, the redundant row decoder 304 will be provided with the same inputs as will the row decoder 104 and will selectively provide equivalent outputs to the row enable lines 138 as will be described hereinafter. That is, the signals provided by the redundant row decoder 304 duplicate the signals provided from the row decoder 104.

It should be noted that the invention is depicted within the prior art context in the example of FIG. 3 by way of example only. The present inventive redundant row decoder 304 could readily be applied for use with other types of video display driver circuits (not shown) such as that described and claimed in the copending application previously referenced herein. Additionally, it is anticipated that the inventive redundant row decoder 304 could be applied to yet other types of video array arrangements including some that might not yet have been devised.

Figure 2:
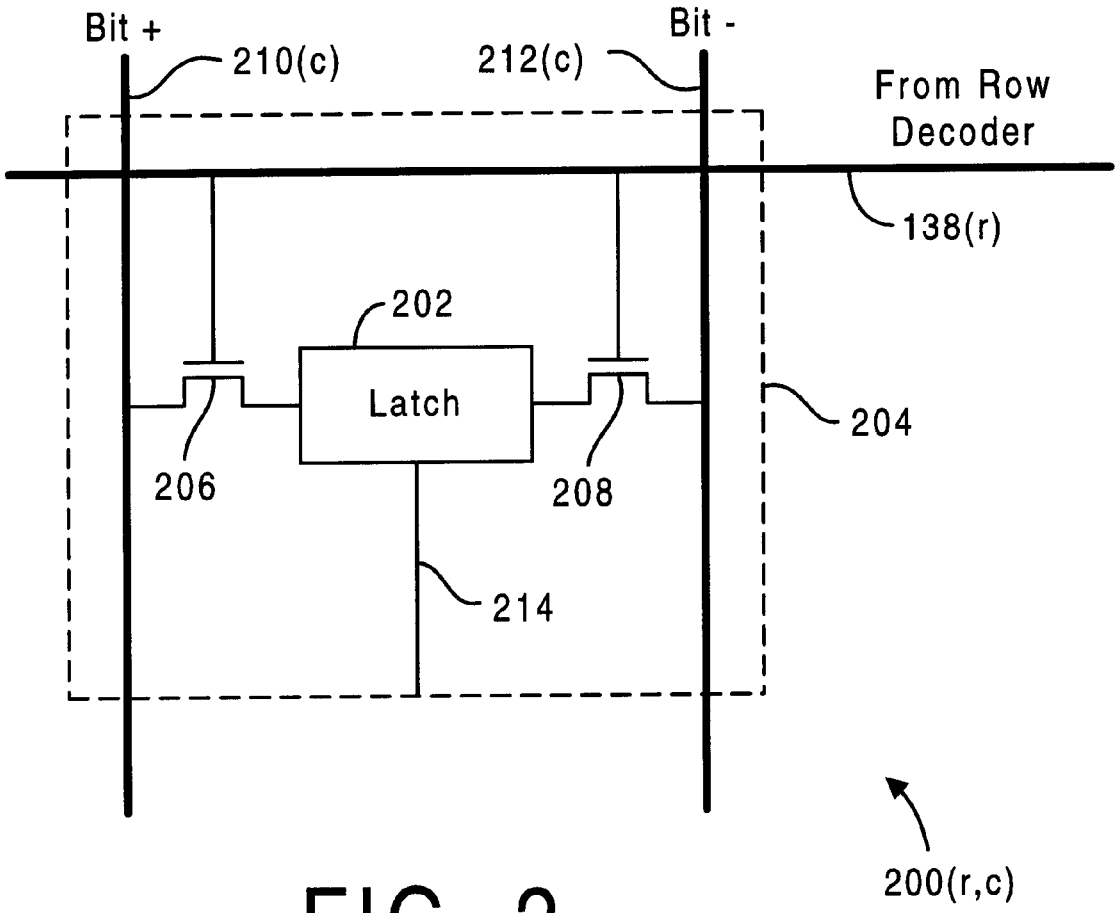
FIG. 2 Prior Art
FIG. 2 is a block diagram of an exemplary pixel cell of a pixel array shown in FIG. 1.
Figure 4:
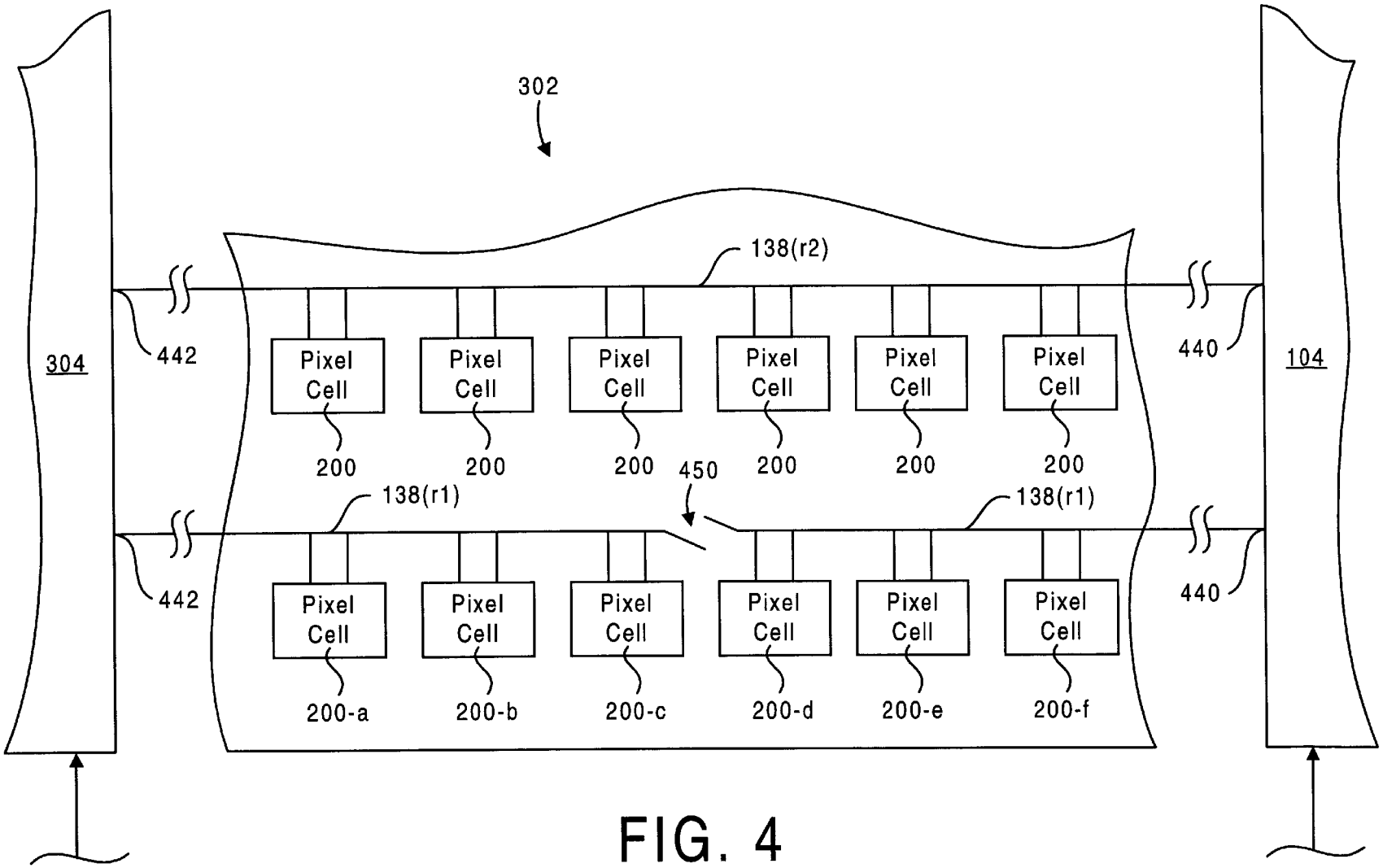
FIG. 4 is a block schematic diagram showing a portion of the video pixel array of FIG. 3.

FIG. 4 is a block schematic diagram showing a portion of the improved pixel array 302. In the view of FIG. 4 only 2 rows of the total of 756 in the entire video pixel array 102 (FIG. 3) are depicted. Furthermore, in order to more clearly illustrate the invention, only 6 of the pixel cells 200 of the 1024 total pixel cells 200 of the embodiment being discussed are illustrated in the view of FIG. 4. It should be noted that row enable lines 138(*r*1) and 138(*r*2) are not, in and of themselves, different from the example of the row enable line 138 depicted in the prior art example of FIG. 2. It will be recognized that the row enable lines 138(*r*1) and 138(*r*2) of FIG. 4 are a subset of the row enable line 138 of FIG. 3. In the present example, the row enable line 138 of FIG. 3 will have 756 (one for each row of the pixel cells 200) of the individual row enable lines such as the examples at 138(*r*1) and 138(*r*2) therein. In the view of FIG. 4, the details of the pixel cells 200, which are shown in the example of FIG. 2, are omitted for the sake of clarity, as are the data lines 110(*c*) and 121 (*c*) of FIG. 2. The improved pixel array 302 is much like the pixel array 102 of FIG. 1 with the exception that the row enable lines 138(*r*1) and 138(*r*2) run entirely through and out of the improved pixel array 302 at each end and connect at the respective ends thereof to the row decoder 104 and the redundant row decoder 304, as depicted in the diagram of FIG. 4. In the example of FIG. 4, the row decoder 104 is connected to each of the row enable lines 138(*r*1) and 138(*r*2) at a first connection point 440 located at one end of the row enable lines 138(*r*1) and 138(*r*2) and the redundant row decoder 304 is connected to each of the row enable lines 138(*r*1) and 138(*r*2) at a second connection point 442 locate at an opposite end of the row enable lines 138(*r*1) and 138(*r*2).

A circuit discontinuity 450 is depicted in the view of FIG. 4 occurring in the row enable line 138(*r*1). It can be appreciated that, in the simplified example of FIG. 4, the pixel cells 200*a*, 200*b* and 200*c* will be enabled by the redundant row decoder 304 while the pixel cells 200*d*, 200*e*, and *200*f will be enabled by the row decoder 104. Therefore, the fact that the circuit discontinuity 450 exists will not substantially affect the performance of the improved pixel array 302 at all. It will be noted that the circuit discontinuity could be a manufacturing defect, or else could be a break in the row enable line 138(*r*1) such as might occur from rough handling, or the like, after manufacture.

One skilled in the art will recognize that there are other possible applications of the invention described herein. For example, although it is anticipated that the inventive improved video display driver circuit 300 and the improved pixel array 302 be embodied on a single silicon substrate, it is within the scope of the invention that the various components be embodied separately. Also, as previously discussed herein, although the described embodiment is placed in the context of a simple display driver circuit similar to that known in the prior art, the invention is equally applicable to be applied to more sophisticated and/or innovative technologies.

Yet another likely modification would be to physically relocate the row decoder 104 and/or the redundant row decoder 304. An example of such relocation might be to physically place the row decoder 104 and/or the redundant row decoder 304 within the physical boundaries of the improved pixel array 302. It is anticipated that the present invention will result in a significant improvement in production yields as compared to the prior art. Therefore, there should be a significant economic advantage upon application of the invention to video array devices, including both those known in the prior art and those which might be developed in the future. All of the above are only some of the examples of available embodiments of the present invention. Those skilled in the art will readily observe that numerous other modifications and alterations may be made without departing form the spirit and scope of the invention. Accordingly, the above disclosure is not intended as limiting and the appended claims are to be interpreted as encompassing the entire scope of the invention.

What is claimed is:

1. A video array driver circuit for providing signals to a video pixel array, comprising:

a first row enable driver for selectively providing signals to each of a plurality of row enable lines in the video pixel array; and a second row enable driver for selectively providing signals to said plurality of row enable lines in the video pixel array.

2. The video array driver circuit of claim 1, wherein:

both said first row enable driver and said second row enable driver are each connected to each of the row enable lines of the video pixel array.

3. The video array driver circuit of claim 1, wherein:

said first row enable driver and said second row enable driver are each connected to each of the row enable lines of the video pixel array at different locations on the row enable line.

4. The video array driver circuit of claim 1, wherein:

said first row enable driver is connected to each of the row enable lines at a first end of the row enable line; and said second row enable driver is connected to each of the row enable lines at a second end of the row enable line.

5. The video array driver circuit of claim 1, wherein:

the video array driver circuit and the video pixel array are both embodied in a unitary semiconductor substrate.

6. A method for improving production yield in a video pixel array, comprising:

a) providing two connection points to each of a plurality of row enable lines;

b) connecting a first row decoder to each of a first of said two connection points; and c) connecting a second row decoder to each of a second of said two connection points.

7. The method of claim 6, wherein:

the first connection points are located at a first end of each of the row enable lines; and the second connection points are located at an opposite end of each of the row enable lines.

8. The method of claim 6, wherein:

each of a plurality of pixel cells connected to each of the row enable lines is electrically connected to one or both of the first row decoder and the second row decoder even when a single circuit discontinuity is present in that row enable line.

9. A video pixel array device, comprising:

a plurality of pixel cells arranged in rows and columns with each row of said pixel cells connected to a row enable line;

a first row driver connection point on each of the row enable lines;

a second row driver connection point on each of the row enable lines;

a first row decoder for providing signal to each of the row enable lines via said first row driver connection point; and a second row decoder for providing signal to each of the row enable lines via said second row driver connection point.

10. The video pixel array device of claim 9, wherein:

said first row driver connection point and said second row driver connection point are located at opposite ends of each of the row enable lines.

11. The video pixel array device of claim 9, and further including:

a circuit discontinuity in at least one of the row enable lines such that each of the pixel cells connected to that row enable line is electrically connected to one, but not both, of said first row decoder and said second row decoder.

12. The video pixel array device of claim 9, wherein:

said pixel cells are liquid crystal display video imaging cells.

* * * * *